US011994044B2

(12) United States Patent
Kokumai et al.

(10) Patent No.: US 11,994,044 B2
(45) Date of Patent: May 28, 2024

(54) VALVE TIMING ADJUSTMENT DEVICE

(71) Applicant: DENSO CORPORATION, Kariya (JP)

(72) Inventors: Hikaru Kokumai, Kariya (JP); Futoshi Kawamura, Kariya (JP); Kinya Takahashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 107 days.

(21) Appl. No.: 17/894,529

(22) Filed: Aug. 24, 2022

(65) Prior Publication Data

US 2022/0412235 A1 Dec. 29, 2022

Related U.S. Application Data

(63) Continuation of application No. PCT/JP2021/006593, filed on Feb. 22, 2021.

(30) Foreign Application Priority Data

Feb. 26, 2020 (JP) ..... 2020-030036

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426
See application file for complete search history.

(56) References Cited

U.S. PATENT DOCUMENTS

2011/0259289 A1* 10/2011 Fujiyoshi ..... F01L 1/3442 123/90.15
2013/0133599 A1* 5/2013 Ikuma ..... F01L 1/34 123/90.17
2019/0323392 A1 10/2019 Mitsutani
2022/0074323 A1* 3/2022 Takada ..... F16K 11/0716

FOREIGN PATENT DOCUMENTS

CN 105 019 961 11/2015
CN 105386808 B * 7/2019 ..... F01L 1/344
DE 10 2016 200 788 7/2017
WO 2021/193197 9/2021

* cited by examiner

*Primary Examiner* — Ngoc T Nguyen
(74) *Attorney, Agent, or Firm* — Nixon & Vanderhye P.C.

(57) ABSTRACT

A valve timing adjustment device includes a hydraulic oil control valve. The hydraulic oil control valve includes: an outer sleeve that is shaped in a tubular form and has a projection at an outer periphery of the outer sleeve; an inner sleeve that is located on an inner side of the outer sleeve; and a spool that is located at an inside of the inner sleeve. A reference-shape portion, which serves as a reference at a time of positioning the outer sleeve relative to the inner sleeve, is formed at an outer periphery of the projection. A seat surface of the projection, which fixes a vane rotor between the seat surface of the projection and an end portion of one of a drive shaft and a driven shaft, is shaped in a rotationally symmetric form that is rotationally symmetric around a rotational axis.

5 Claims, 12 Drawing Sheets

VALVE TIMING ADJUSTMENT DEVICE

CROSS REFERENCE TO RELATED APPLICATIONS

This application is a continuation application of International Patent Application No. PCT/JP2021/006593 filed on Feb. 22, 2021, which designated the U.S. and claims the benefit of priority from Japanese Patent Application No. 2020-030036 filed on Feb. 26, 2020. The entire disclosures of all of the above applications are incorporated herein by reference.

TECHNICAL FIELD

The present disclosure relates to a valve timing adjustment device.

BACKGROUND

Previously, there has been proposed a hydraulic valve timing adjustment device that is configured to adjust a valve timing of intake valves or exhaust valves of an internal combustion engine. A sleeve for changing a port among a plurality of ports is provided at an inside of this valve timing adjustment device. This sleeve has a double structure made of two components, specifically, an inner sleeve and an outer sleeve. The ports, which communicate between a valve interior and variable cam timing (VCT) hydraulic oil chambers, extend through these two components.

SUMMARY

This section provides a general summary of the disclosure, and is not a comprehensive disclosure of its full scope or all of its features.

According to the present disclosure, there is provided a valve timing adjustment device configured to adjust an opening timing and a closing timing of a valve, which is installed at an internal combustion engine, relative to a rotational phase of a drive shaft of the internal combustion engine. The valve timing adjustment device includes a hydraulic oil control valve that includes:

- an outer sleeve that is shaped in a tubular form and has a projection at an outer periphery of the outer sleeve;
- an inner sleeve that is located on an inner side of the outer sleeve; and
- a spool that is located at an inside of the inner sleeve and is configured to reciprocate forward and backward along a rotational axis of the outer sleeve, wherein the inner sleeve and the outer sleeve are assembled together to form a plurality of ports, each of which serves as an oil passage, and a hydraulic oil pressure of hydraulic oil, which is supplied from a hydraulic oil supply source through corresponding one or more of the plurality of ports, is controlled by reciprocating the spool forward or backward. A reference-shape portion, which serves as a reference at a time of positioning the outer sleeve relative to the inner sleeve, is formed at an outer periphery of the projection.

BRIEF DESCRIPTION OF DRAWINGS

The present disclosure, together with additional objectives, features and advantages thereof, will be best understood from the following description in view of the accompanying drawings.

DETAILED DESCRIPTION

Figure 1:
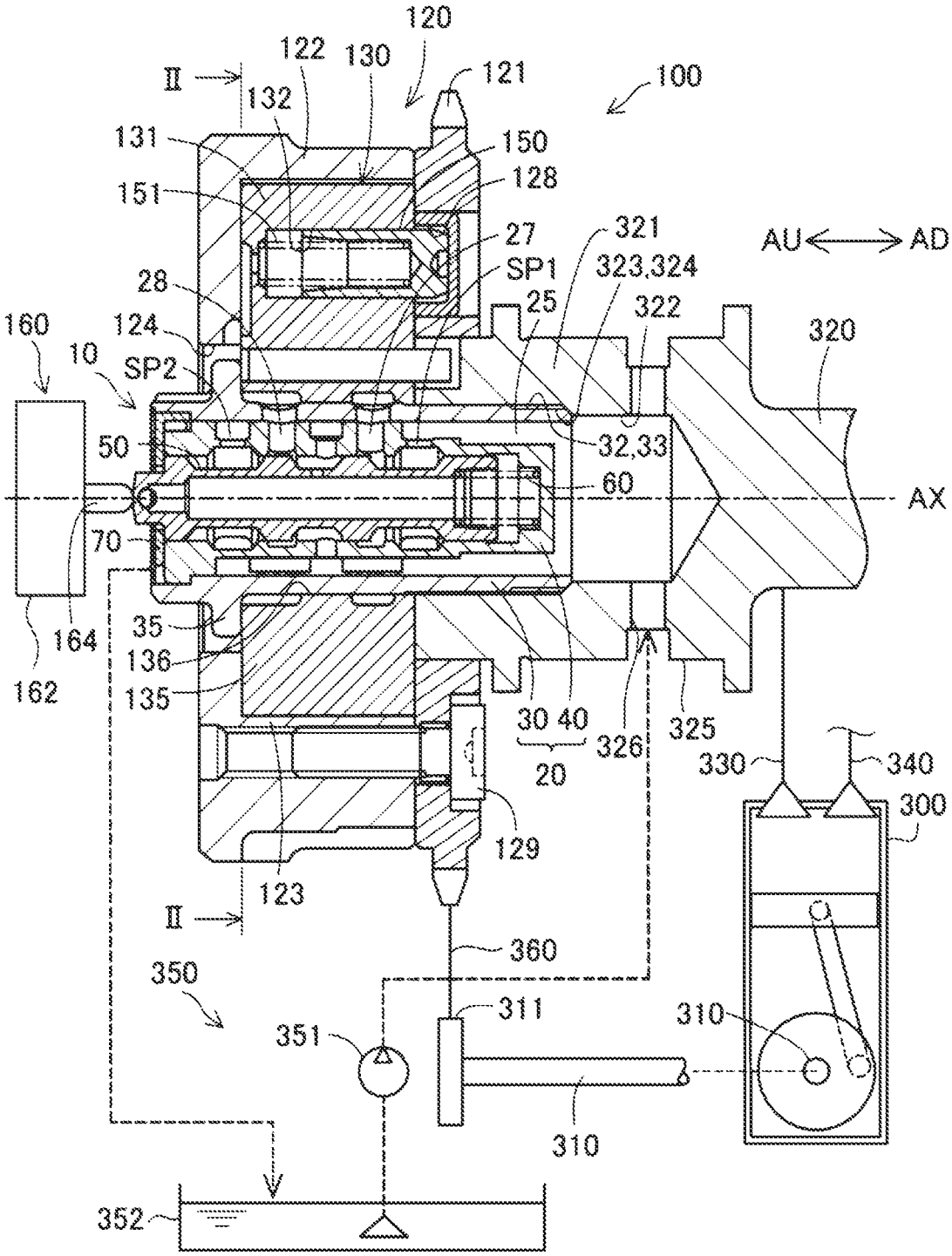
FIG. 1 is a cross-sectional view showing a schematic structure of a valve timing adjustment device including a hydraulic oil control valve.

Previously, there has been proposed a hydraulic valve timing adjustment device that is configured to adjust a valve timing of intake valves or exhaust valves of an internal combustion engine. A sleeve for changing a port among a plurality of ports is provided at an inside of this valve timing adjustment device. This sleeve has a double structure made of two components, specifically, an inner sleeve and an outer sleeve. The ports, which communicate between a valve interior and variable cam timing (VCT) hydraulic oil chambers, extend through these two components.

In a case where the two components, i.e., the inner sleeve and the outer sleeve are assembled to the valve timing adjustment device, angles of these two components need to be adjusted. For this angle adjustment, it is desirable that an angle reference is formed at each component.

The present disclosure can be implemented as follows.

According to one aspect of the present disclosure, there is provided a valve timing adjustment device configured to adjust an opening timing and a closing timing of a valve, which is installed at an internal combustion engine, relative to a rotational phase of a drive shaft of the internal combustion engine. The valve timing adjustment device includes:

a hydraulic oil control valve that includes:

an outer sleeve that is shaped in a tubular form and has a projection at an outer periphery of the outer sleeve;

an inner sleeve that is located on an inner side of the outer sleeve; and a spool that is located at an inside of the inner sleeve and is configured to reciprocate forward and backward along a rotational axis of the outer sleeve, wherein the inner sleeve and the outer sleeve are assembled together to form a plurality of ports, each of which serves as an oil passage, and a hydraulic oil pressure of hydraulic oil, which is supplied from a hydraulic oil supply source through corresponding one or more of the plurality of ports, is controlled by reciprocating the spool forward or backward;

an actuator that is configured to control reciprocation of the spool; and a vane rotor that is installed between a driven shaft and the drive shaft while the driven shaft is configured to open and close the valve in response to rotation of the drive shaft, wherein the vane rotor is configured to change a rotational phase of the driven shaft relative to the drive shaft according to the hydraulic oil pressure of the hydraulic oil supplied from the hydraulic oil control valve. A reference-shape portion, which serves as a reference at a time of positioning the outer sleeve relative to the inner sleeve, is formed at an outer periphery of the projection. A seat surface of the projection, which fixes the vane rotor between the seat surface of the projection and an end portion of one of the drive shaft and the driven shaft, is shaped in a rotationally symmetric form that is rotationally symmetric around the rotational axis.

According to this aspect, the angles of the inner sleeve and the outer sleeve can be easily adjusted by using the reference-shape portion, which serves as the angle reference. Furthermore, the frictional forces between the seat surface and the vane rotor are generated to be rotationally symmetric around the rotational axis. As a result, a resultant moment of the frictional forces becomes zero, and thereby the translational force is not exerted between the seat surface and the vane rotor. Thus, the fastening between the seat surface and the vane rotor can be stabilized.

Hereinafter, embodiments of the present disclosure will be described. First of all, a structure of a valve timing adjustment device, which is common to all of the embodiments, will be described.

A. Structure and Operation of Valve Timing Adjustment Device 100

A structure and an operation of a valve timing adjustment device 100 used in embodiments of the present disclosure will be described first, and then characteristic features of the present disclosure will be described.

(A-1. Device Structure)

An internal combustion engine 300 of a vehicle (not shown) opens and closes intake valves (serving as valves) 330 and exhaust valves (serving as valves) 340 through a corresponding one of camshafts 320 (only one of the camshafts 320 is shown in FIG. 1) that receive a drive force from a crankshaft 310. The valve timing adjustment device 100 shown in FIG. 1 is installed in a drive force transmission path extending from the crankshaft 310 to the camshaft 320 and adjusts an opening timing and a closing timing of each of the valves 330, 340 by changing a phase of the camshaft 320 relative to the crankshaft 310. More specifically, the valve timing adjustment device 100 is fixed to an end portion 321 of the camshaft 320 in an axial direction of a rotational axis AX of the camshaft 320. The rotational axis AX of the valve timing adjustment device 100 coincides with the rotational axis AX of the camshaft 320. The valve timing adjustment device 100 of the present embodiment adjusts the opening timing and the closing timing of the intake valves 330 among the intake valves 330 and the exhaust valves 340, which serve as the valves.

The valve timing adjustment device 100 includes: a housing 120; a vane rotor 130 installed at an inside of the housing 120; and a hydraulic oil control valve 10. The hydraulic oil control valve 10 includes: an outer sleeve 30; an inner sleeve 40 located on an inner side of the outer sleeve 30; and a spool 50 that is located at an inside of the inner sleeve 40 and is configured to reciprocate forward and backward along the rotational axis AX of the outer sleeve 30. The outer sleeve 30 and the inner sleeve 40 are assembled together and form a plurality of ports 27, 28. The hydraulic oil control valve 10 supplies the hydraulic oil to a gap between the housing 120 and the vane rotor 130 through at least one of the ports 27, 28 according to a position of the spool 50 in the inside of the inner sleeve 40 and thereby changes a phase between the housing 120 and the vane rotor 130 to adjust the valve timing.

A shaft hole 322 is formed at a center of the end portion 321 of the camshaft 320, and a supply hole 326 is formed at an outer peripheral surface of the end portion 321 of the camshaft 320. The shaft hole 322 extends along the rotational axis AX. A shaft fixing portion 323 for fixing the hydraulic oil control valve 10 is formed at an inner peripheral surface of the shaft hole 322. A female-threaded portion 324 is formed at the shaft fixing portion 323. The female-threaded portion 324 is threadably engaged with a male-threaded portion 33 that is formed at a fixing portion 32 of the hydraulic oil control valve 10. The supply hole 326 extends in a radial direction of the camshaft 320 and communicates between an outer peripheral surface 325 of the camshaft 320 and the shaft hole 322. An oil reservoir (not shown) is formed at the outer peripheral surface 325. The hydraulic oil, which is supplied from the hydraulic oil supply source 350, is supplied from the oil reservoir to the hydraulic oil control valve 10 through the supply hole 326 and the shaft hole 322. The hydraulic oil supply source 350 includes an oil pump 351 and an oil pan 352. The oil pump 351 suctions the hydraulic oil stored in the oil pan 352.

The housing 120 includes a sprocket 121 and a case 122. The sprocket 121 is rotatably fitted to the end portion 321 of the camshaft 320. A fitting recess 128 is formed at the sprocket 121 at a location that corresponds to a lock pin 150 described later. A timing chain 360, which is shaped in a ring form, is wound around the sprocket 121 and a sprocket 311 of the crankshaft 310. The sprocket 121 is fixed to the case 122 by a plurality of bolts 129. Therefore, the housing 120 is rotated synchronously with the crankshaft 310. The case 122 is shaped in a bottomed tubular form, and an opening end of the case 122 is closed by the sprocket 121. An opening 124 is formed at a center of a bottom portion of the case 122 which is opposite from the sprocket 121.

Figure 2:
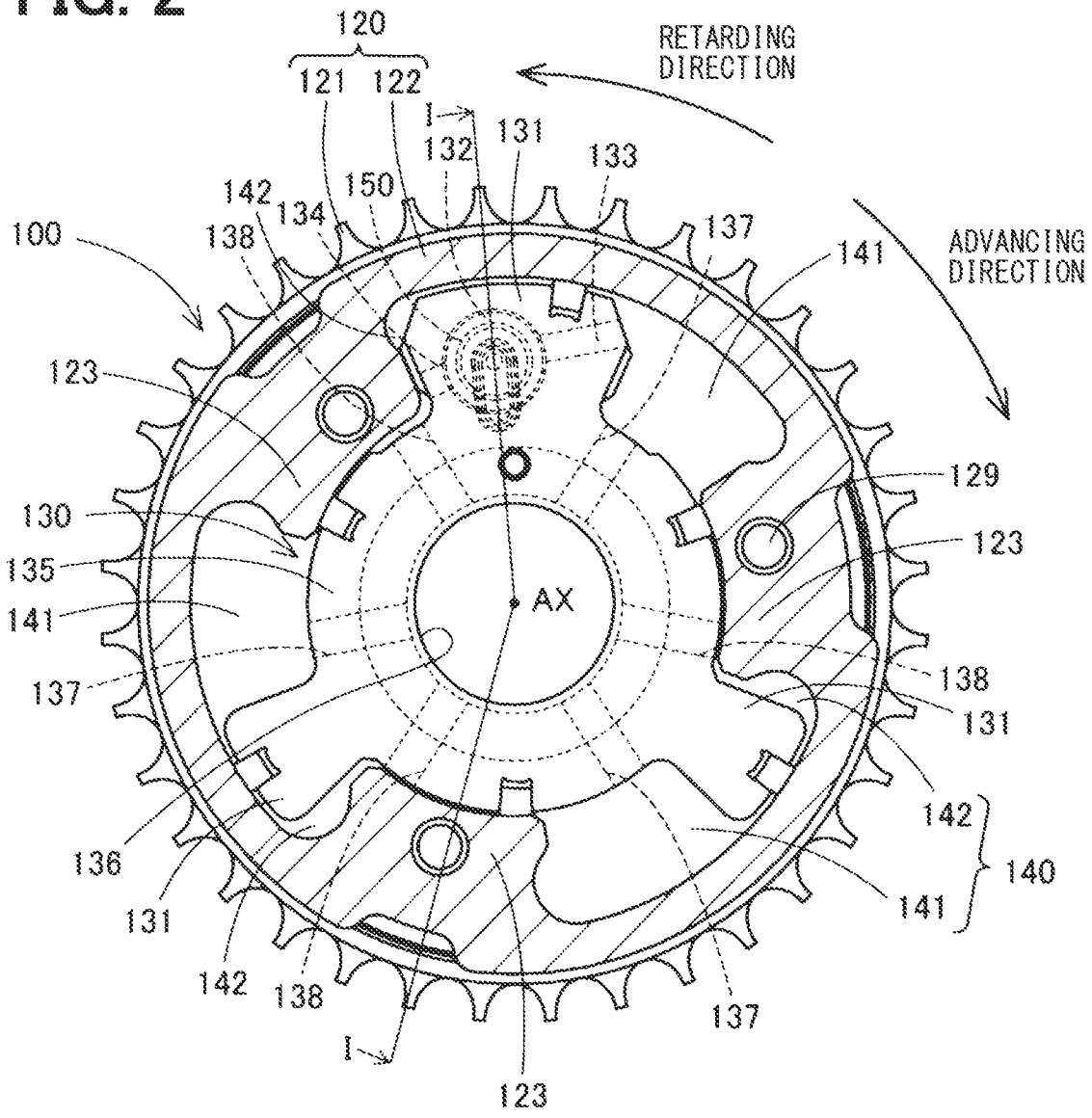
FIG. 2 is a cross-sectional view showing a cross-section taken along line II-II in FIG. 1.

As shown in FIG. 2, the case 122 has a plurality of partition wall portions 123 which project radially inward and are arranged one after another in a circumferential direction. In FIG. 2, indication of the hydraulic oil control valve 10 is omitted for the sake of simplicity. A space, which is formed between each adjacent two of the partition wall portions 123, functions as a hydraulic oil chamber 140.

The vane rotor 130 is received at an inside of the housing 120 and is rotated in a retarding direction or an advancing direction relative to the housing 120 according to a hydraulic oil pressure of the hydraulic oil which is supplied from the hydraulic oil control valve 10 through a plurality of retard oil passages 137 or a plurality of advance oil passages 138. Therefore, the vane rotor 130 functions as a phase changing portion that changes a phase of the driven shaft relative to the drive shaft. The vane rotor 130 has a plurality of vanes 131 and a boss 135.

The boss 135 is shaped in a tubular form and is fixed to the end portion 321 of the camshaft 320. Therefore, the vane rotor 130, which has the boss 135, is fixed to the end portion 321 of the camshaft 320 and is rotated integrally with the camshaft 320. A through-hole 136 extends through a center of the boss 135 in the axial direction of the rotational axis AX. The hydraulic oil control valve 10 is installed in the through-hole 136. The retard oil passages 137 and the advance oil passages 138 radially extend through the boss 135. Each of the retard oil passages 137 and an adjacent one of the advance oil passages 138 are arranged one after the other in the axial direction of the rotational axis AX. Each of the retard oil passages 137 communicates between a corresponding one of a plurality of retard ports 27 of the hydraulic oil control valve 10 described later and a corresponding one of a plurality of retard chambers 141 described later. Each of the advance oil passages 138 communicates between a corresponding one of a plurality of advance ports 28 of the hydraulic oil control valve 10 described later and a corresponding one of a plurality of advance chambers 142 described later. The outer sleeve 30 of the hydraulic oil control valve 10 seals between each retard oil passage 137 and each advance oil passage 138 in the through-hole 136.

Each of the vanes 131 radially outwardly projects from the boss 135, which is located at the center of the vane rotor 130, such that the vanes 131 are arranged one after another in the circumferential direction. Each of the vanes 131 is received in a corresponding one of the hydraulic oil chambers 140 and partitions the corresponding hydraulic oil chamber 140 into the retard chamber 141 and the advance chamber 142 in the circumferential direction. The retard chamber 141 is located on one side of the vane 131 in the circumferential direction. The advance chamber 142 is located on the other side of the vane 131 in the circumferential direction.

A receiving hole 132 is formed to extend in the axial direction in one of the vanes 131. The receiving hole 132 is communicated with the corresponding retard chamber 141 through a retard chamber side pin control oil passage 133 formed at the one of the vanes 131 and is communicated with the corresponding advance chamber 142 through an advance chamber side pin control oil passage 134 formed at the one of the vanes 131. The lock pin 150, which is configured to reciprocate in a direction AD and a direction AU, is received in the receiving hole 132. Here, the direction AD is a direction toward the camshaft 320 along the rotational axis AX, and the direction AU is a direction away from the camshaft 320 along the rotational axis AX. The lock pin 150 limits relative rotation of the vane rotor 130 relative to the housing 120 to limit a collision between the housing 120 and the vane rotor 130 in the circumferential direction in a state where the hydraulic oil pressure is insufficient. The lock pin 150 is urged by a spring 151 toward the fitting recess 128 formed at the sprocket 121.

In the present embodiment, the housing 120 and the vane rotor 130 are made of an aluminum alloy. However, the material of the housing 120 and the vane rotor 130 is not limited to the aluminum alloy and may be any other metal material, such as iron, stainless steel, or any resin material.

As shown in FIG. 1, the hydraulic oil control valve 10 is arranged along the rotational axis AX of the valve timing adjustment device 100 and controls a flow of the hydraulic oil supplied from the hydraulic oil supply source 350. An operation of the hydraulic oil control valve 10 is controlled by a command outputted from an undepicted electronic control unit (ECU) that is configured to control an entire operation of the internal combustion engine 300. The hydraulic oil control valve 10 is driven by a solenoid 160 that is located on an opposite side of the hydraulic oil control valve 10 which is opposite to the camshaft 320 in the axial direction of the rotational axis AX. The solenoid 160 includes an electromagnetic device 162 and a shaft 164. The solenoid 160 drives the spool 50 of the hydraulic oil control valve 10 toward the camshaft 320 against an urging force of the spring 60 by driving the shaft 164 in the direction AD through energization of the electromagnetic device 162 based on the command of the ECU. As described later, in the hydraulic oil control valve 10, the spool 50 can be slid in the direction AD or the direction AU in response to a balance between the urging force of the solenoid 160 and the urging force of the spring 60 to switch between the oil passage communicated with the retard chambers 141 and the oil passage communicated with the advance chambers 142.

Figure 3:
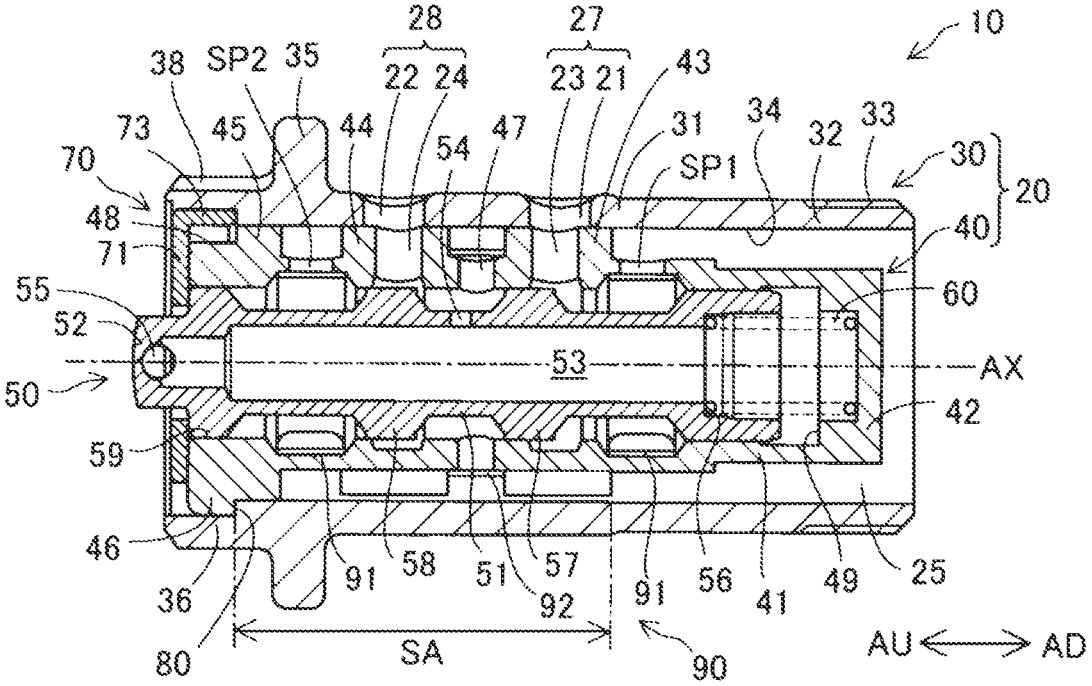
FIG. 3 is a cross-sectional view showing a detailed structure of the hydraulic oil control valve.
Figure 4:
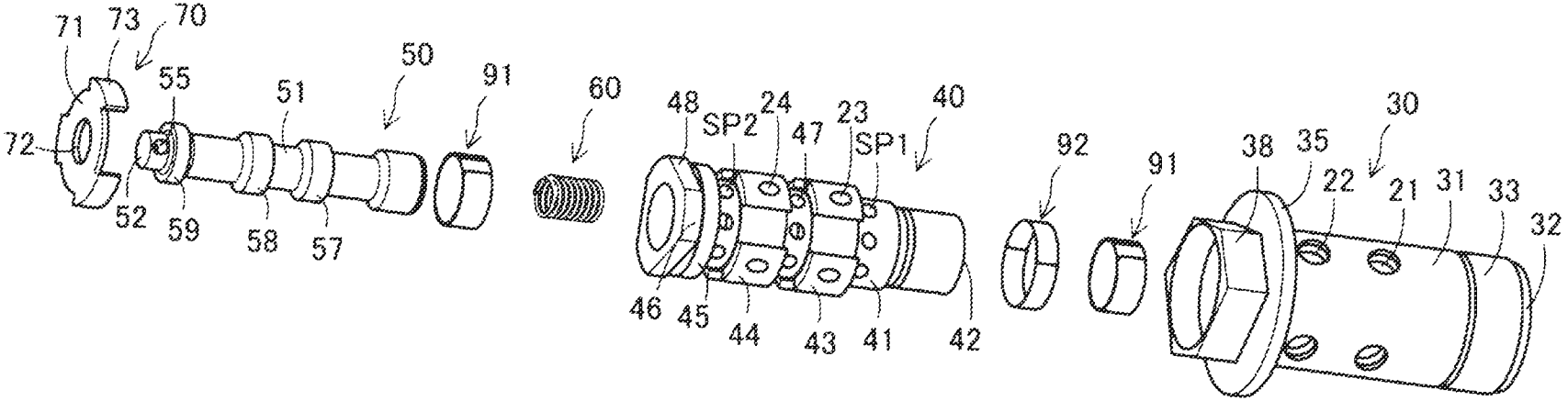
FIG. 4 is an exploded perspective view showing a detailed structure of the hydraulic oil control valve in an exploded state.

As shown in FIGS. 3 and 4, the hydraulic oil control valve 10 includes a sleeve 20, the spool 50, the spring 60, a fixing member 70 and a plurality of check valves 90. FIG. 3 shows a cross-section taken along the rotational axis AX.

The sleeve 20 includes an outer sleeve 30 and an inner sleeve 40. Each of the outer sleeve 30 and the inner sleeve 40 is shaped generally in tubular form. The sleeve 20 is configured such that the inner sleeve 40 is inserted into an axial hole 34 of the outer sleeve 30.

The outer sleeve 30 forms a contour of the hydraulic oil control valve 10 and is located on a radially outer side of the inner sleeve 40. The outer sleeve 30 includes a main body portion 31, the fixing portion 32, a projection 35, an enlarged diameter portion 36, a movement limiting portion 80 and a tool engaging portion 38. The axial hole 34 is formed to extend along the rotational axis AX in the main body portion 31 and the fixing portion 32. The axial hole 34 extends through the outer sleeve 30 along the rotational axis AX.

The main body portion 31 is shaped in a tubular form and is inserted in the through-hole 136 of the vane 131 as shown in FIG. 1. As shown in FIG. 4, a plurality of outer retard ports 21 and a plurality of outer advance ports 22 are formed at the main body portion 31. The outer retard ports 21 are arranged one after another in the circumferential direction and communicate between an outer peripheral surface of the main body portion 31 and the axial hole 34. The outer advance ports 22 are located on the solenoid 160 side of the outer retard ports 21 in the axial direction of the rotational axis AX. The outer advance ports 22 are arranged one after another in the circumferential direction and communicate between the outer peripheral surface of the main body portion 31 and the axial hole 34.

The fixing portion 32 is shaped in a tubular form and is formed continuously with the main body portion 31 in the axial direction of the rotational axis AX. The fixing portion 32 has a diameter that is substantially the same as a diameter of the main body portion 31 and is inserted into the shaft fixing portion 323 of the camshaft 320, as shown in FIG. 1.

The male-threaded portion 33 is formed at the fixing portion 32. The male-threaded portion 33 is threadably engaged with the female-threaded portion 324 that is formed at the shaft fixing portion 323. An axial force is applied to the outer sleeve 30 in the direction AD toward the camshaft 320 by threadably engaging the male-threaded portion 33 and the female-threaded portion 324 together, so that the outer sleeve 30 is fixed to the end portion 321 of the camshaft 320. By the application of the axial force, it is possible to limit a positional deviation between the hydraulic oil control valve 10 and the end portion 321 of the camshaft 320, which would be caused by an eccentric force of the camshaft 320 generated when the intake valves 330 are urged by the camshaft 320. Therefore, leakage of the hydraulic oil can be limited.

The projection 35 radially outwardly projects from the main body portion 31. The projection 35 is in a form of a flange (a circular ring) in this instance but may be in another form of projection in another instance. As shown in FIG. 1, the vane rotor 130 is clamped between the projection 35 and the end portion 321 of the camshaft 320 along the rotational axis AX. Therefore, the outer sleeve 30, the vane rotor 130 and the camshaft 320 are rotated together in the same phase.

As shown in FIG. 3, the enlarged diameter portion 36 is formed at an end portion of the main body portion 31 which is located on the solenoid 160 side. An inner diameter of the enlarged diameter portion 36 is larger than an inner diameter of the rest of the main body portion 31. A flange 46 of the inner sleeve 40 described later is placed at the enlarged diameter portion 36.

The movement limiting portion 80 is formed as a stepped portion of the inner peripheral surface of the outer sleeve 30 which is radially stepped by the enlarged diameter portion 36. The flange 46 of the inner sleeve 40 is clamped between the movement limiting portion 80 and the fixing member 70 along the rotational axis AX. Therefore, the movement limiting portion 80 limits the movement of the inner sleeve 40 in the direction AD away from the electromagnetic device 162 of the solenoid 160 along the rotational axis AX.

The tool engaging portion 38 is located on the solenoid 160 side of the projection 35 of the outer sleeve 30, i.e., is located on the side of the projection 35 away from the camshaft 320 in the direction AU. As shown in FIG. 4, the tool engaging portion 38 is configured to be engaged with a tool (not shown), such as a hexagon socket, and is used to fix the hydraulic oil control valve 10, which includes the outer sleeve 30, to the end portion 321 of the camshaft 320.

The inner sleeve 40 includes a tubular portion 41, a bottom portion 42, a plurality of retard-side projecting walls 43, a plurality of advance-side projecting walls 44, a sealing wall 45, the flange 46 and a stopper 49.

The tubular portion 41 is shaped generally in a tubular form and is located on the radially inner side of the outer sleeve 30 such that the tubular portion 41 extends along the main body portion 31 and the fixing portion 32 of the outer sleeve 30. As shown in FIGS. 3 and 4, a plurality of retard-side supply ports SP1, a plurality of advance-side supply ports SP2 and a plurality of recycle ports 47 are formed at the tubular portion 41.

The retard-side supply ports SP1 are located on the camshaft 320 side of the retard-side projecting walls 43 in the direction AD and communicate between the outer peripheral surface and the inner peripheral surface of the tubular portion 41. In the present embodiment, the retard-side supply ports SP1 are arranged one after another within a circumferential range, which is one-half of a circumference of the tubular portion 41. Alternatively, the retard-side supply ports SP1 may be arranged one after another along an entire circumference of the tubular portion 41. Further alternatively, there may be formed only one retard-side supply port SP1 at the tubular portion 41. The advance-side supply ports SP2 are located on the solenoid 160 side of the advance-side projecting walls 44 in the direction AU and communicate between the outer peripheral surface and the inner peripheral surface of the tubular portion 41. In the present embodiment, the advance-side supply ports SP2 are circumferentially arranged one after another within a circumferential range, which is one-half of the circumference of the tubular portion 41. Alternatively, the advance-side supply ports SP2 may be circumferentially arranged one after another along the entire circumference of the tubular portion 41. Further alternatively, there may be formed only one advance-side supply port SP2 at the tubular portion 41. The retard-side supply ports SP1 are communicated with the shaft hole 322 of the camshaft 320 shown in FIG. 1. Furthermore, as shown in FIG. 4, the advance-side supply ports SP2 are communicated with the retard-side supply ports SP1 through a plurality of gaps, each of which is formed between corresponding adjacent two of the retard-side projecting walls 43, and a plurality of gaps, each of which is formed between corresponding adjacent two of the advance-side projecting walls 44. Thus, the advance-side supply ports SP2 are communicated with the shaft hole 322 of the camshaft 320.

As shown in FIGS. 3 and 4, the recycle ports 47 are formed between the retard-side projecting walls 43 and the advance-side projecting walls 44 and communicate between the outer peripheral surface and the inner peripheral surface of the tubular portion 41. The recycle ports 47 are communicated with the retard-side supply ports SP1 and the advance-side supply ports SP2. Specifically, the recycle ports 47 are communicated with the retard-side supply ports SP1 through the spaces, each of which is radially formed between the inner peripheral surface of the outer sleeve 30 and the outer peripheral surface of the tubular portion 41 of the inner sleeve 40 and is circumferentially formed between the corresponding adjacent two of the retard-side projecting walls 43, and the recycle ports 47 are communicated with the advance-side supply ports SP2 through the spaces, each of which is radially formed between the inner peripheral surface of the outer sleeve 30 and the outer peripheral surface of the tubular portion 41 of the inner sleeve 40 and is circumferentially formed between the corresponding adjacent two of the advance-side projecting walls 44. Therefore, the recycle ports 47 function as a recycle mechanism that returns the hydraulic oil, which is discharged from the retard chambers 141 and the advance chambers 142, to the supply side. In the present embodiment, the recycle ports 47 are arranged one after another in the circumferential direction. Alternatively, there may be formed only one recycle port 47. An operation of the valve timing adjustment device 100 including the operation of switching the oil passage by sliding the spool 50 will be described later.

As shown in FIG. 3, the bottom portion 42 is formed integrally with the tubular portion 41 in one-piece and closes an end portion of the tubular portion 41 located on the camshaft 320 side in the direction AD. One end portion of the spring 60 contacts the bottom portion 42.

As shown in FIG. 4, the retard-side projecting walls 43 radially outwardly project from the tubular portion 41 and are arranged one after another in the circumferential direction. The spaces, each of which is formed between the corresponding circumferentially adjacent two of the retard-side projecting walls 43, are communicated with the shaft hole 322 of the camshaft 320 shown in FIG. 1 and conduct the hydraulic oil supplied from the hydraulic oil supply source 350. As shown in FIGS. 3 and 4, each of the inner retard ports 23 is formed at the corresponding one of the retard-side projecting walls 43. Each inner retard port 23 communicates between an outer peripheral surface and an inner peripheral surface of the corresponding one of the retard-side projecting walls 43. As shown in FIG. 3, each of the inner retard ports 23 is communicated with the corresponding one of the outer retard ports 21 of the outer sleeve 30. A central axis of each of the inner retard ports 23 is deviated from a central axis of the corresponding outer retard port 21 in the axial direction of the rotational axis AX.

As shown in FIG. 4, the advance-side projecting walls 44 are located on the solenoid 160 side of the retard-side projecting walls 43 in the direction AU. The advance-side projecting walls 44 radially outwardly project from the tubular portion 41 and are arranged one after another in the circumferential direction. The spaces, each of which is formed between the corresponding adjacent two of the advance-side projecting walls 44, are communicated with the shaft hole 322 shown in FIG. 1 and conduct the hydraulic oil supplied from the hydraulic oil supply source 350. As shown in FIGS. 3 and 4, each of the inner advance ports 24 is formed at the corresponding one of the advance-side projecting walls 44. Each inner advance port 24 communicates between an outer peripheral surface and an inner peripheral surface of the corresponding one of the advance-side projecting walls 44. As shown in FIG. 3, each of the inner advance ports 24 is communicated with the corresponding one of the outer advance ports 22 of the outer sleeve 30. A central axis of the inner advance port 24 is deviated from a central axis of the corresponding outer advance port 22 in the axial direction of the rotational axis AX.

The sealing wall 45 is located on the solenoid 160 side of the advance-side supply ports SP2 in the direction AU and radially outwardly projects from the tubular portion 41 along the entire circumference of the tubular portion 41. The sealing wall 45 seals between the inner peripheral surface of the main body portion 31 of the outer sleeve 30 and the outer peripheral surface of the tubular portion 41 of the inner sleeve 40 to limit leakage of the hydraulic oil, which is conducted in a hydraulic oil supply passage 25 described later, to the solenoid 160 side. An outer diameter of the sealing wall 45 is generally the same as an outer diameter of the retard-side projecting walls 43 and an outer diameter of the advance-side projecting walls 44.

The flange 46 is located at the end portion of the inner sleeve 40 on the solenoid 160 side and radially outwardly projects from the tubular portion 41 along the entire circumference of the tubular portion 41. The flange 46 is held at the enlarged diameter portion 36 of the outer sleeve 30. As shown in FIG. 4, a plurality of fitting portions 48 are formed at the flange 46. The fitting portions 48 are located at an outer periphery of the flange 46 and are arranged one after another in the circumferential direction. In the present embodiment, each fitting portion 48 is formed by linearly cutting a corresponding portion of the outer periphery of the flange 46. However, instead of forming the fitting portion 48 in the linear form (a planar surface form), the fitting portion 48 may be formed in a curved form (a curved surface form). Each of the fitting portions 48 is engaged with a corresponding one of a plurality of fitting projections 73 of the fixing member 70 described later.

The stopper 49 shown in FIG. 3 is formed at the end portion of the inner sleeve 40 on the camshaft 320 side in the direction AD. The stopper 49 has an inner diameter smaller than an inner diameter of the other portion of the tubular portion 41, so that the end portion of the spool 50 located on the camshaft 320 side can contact the stopper 49. The stopper 49 defines a sliding limit of the spool 50 in the direction away from the electromagnetic device 162 of the solenoid 160.

A space, which is formed between an inner peripheral surface of the axial hole 34 of the outer sleeve 30 and an outer peripheral surface of the inner sleeve 40, functions as the hydraulic oil supply passage 25. The hydraulic oil supply passage 25 is communicated with the shaft hole 322 of the camshaft 320 shown in FIG. 1 and conducts the hydraulic oil, which is supplied from the hydraulic oil supply source 350, to the retard-side supply ports SP1 and the advance-side supply ports SP2. As shown in FIG. 3, each of the outer retard ports 21 and the corresponding one of the inner retard ports 23 form the retard port 27 that is communicated with the corresponding retard chamber 141 through the corresponding retard oil passage 137 shown in FIG. 2. As shown in FIG. 3, each of the outer advance ports 22 and the corresponding one of the inner advance ports 24 form the advance port 28 that is communicated with the corresponding advance chamber 142 through the corresponding advance oil passage 138 shown in FIG. 2.

As shown in FIG. 3, the outer sleeve 30 and the inner sleeve 40 are sealed relative to each other at least a portion thereof in the axial direction of the rotational axis AX to limit the leakage of the hydraulic oil. More specifically, the retard-side projecting walls 43 seal between: the retard-side supply ports SP1 and the recycle ports 47; and the retard ports 27, and the advance-side projecting walls 44 seal between: the advance-side supply ports SP2 and the recycle ports 47; and the advance ports 28. Furthermore, the sealing wall 45 seals between the hydraulic oil supply passage 25 and the outside of the hydraulic oil control valve 10. Specifically, a range, which is from the retard-side projecting walls 43 to the sealing wall 45 in the axial direction of the rotational axis AX, is set as a sealing range SA. Furthermore, in the present embodiment, an inner diameter of the main body portion 31 of the outer sleeve 30, is generally constant in the sealing range SA.

The spool 50 is located on the radially inner side of the inner sleeve 40. The spool 50 is driven by the solenoid 160, which is in contact with one end of the spool 50, such that the spool 50 is slid in the direction AD or the direction AU and is thereby reciprocated forward or backward in the inside of the inner sleeve 40 in response to the balance between the urging force of the solenoid 160 and the urging force of the spring 60.

Figure 5:
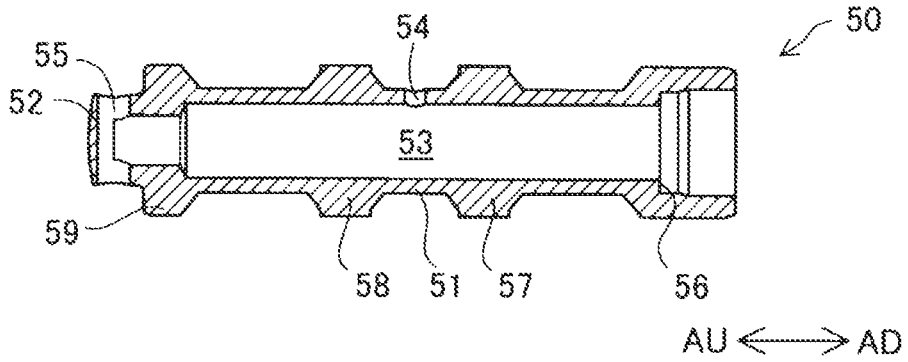
FIG. 5 is a cross-sectional view showing a detailed structure of a spool.

As shown in FIGS. 3 and 5, the spool 50 includes a spool tubular portion 51, a spool bottom portion 52 and a spring receiving portion 56. The spool 50 has at least a portion of a drain oil passage 53, drain inflow ports 54 and drain outflow ports 55. FIG. 5 shows a cross-section of the spool 50 which is circumferentially rotated by 90 degrees relative to a cross-section of the spool 50 shown in FIG. 3.

Figure 6:
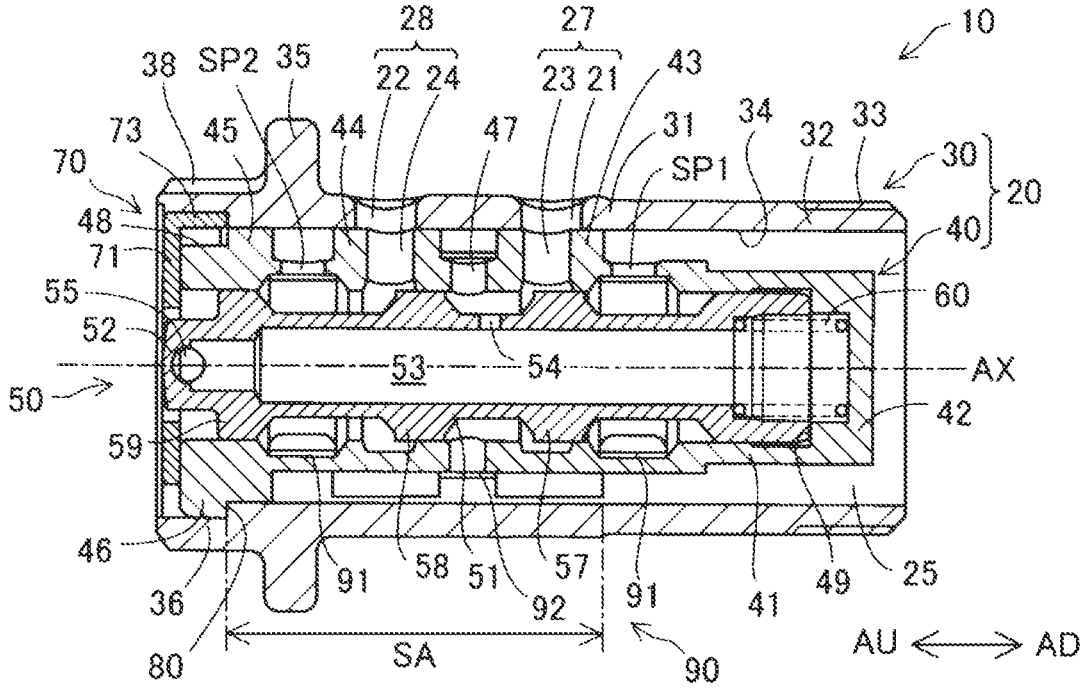
FIG. 6 is a cross-sectional view showing a state in which the spool is in contact with a stopper.

As shown in FIGS. 3 to 5, the spool tubular portion 51 is shaped generally in a tubular form. A retard-side seal portion 57, an advance-side seal portion 58 and an engaging portion 59 are arranged in this order from the camshaft 320 side in the axial direction of the rotational axis AX at an outer peripheral surface of the spool tubular portion 51. The retard-side seal portion 57, the advance-side seal portion 58 and the engaging portion 59 radially outwardly project and circumferentially extend all around the spool tubular portion 51. As shown in FIG. 3, in a state where the spool 50 is placed in a closest position, in which the spool 50 is closest to the electromagnetic device 162 of the solenoid 160, the retard-side seal portion 57 disrupts the communication between the recycle ports 47 and the retard ports 27. Furthermore, as shown in FIG. 6, in another state where the spool 50 is placed in a furthermost position, in which the spool 50 is furthermost from the electromagnetic device 162, the retard-side seal portion 57 disrupts the communication between the retard-side supply ports SP1 and the retard ports 27. As shown in FIG. 3, in the state where the spool 50 is placed in the closest position, in which the spool 50 is closest to the electromagnetic device 162, the advance-side seal portion 58 disrupts the communication between the advance-side supply ports SP2 and the advance ports 28. Furthermore, as shown in FIG. 6, in the other state where the spool 50 is placed in the furthermost position, in which the spool 50 is furthermost from the electromagnetic device 162, the advance-side seal portion 58 disrupts the communication between the recycle ports 47 and the advance ports 28. As shown in FIG. 3, the engaging portion 59 defines another sliding limit of the spool 50 in the direction toward the electromagnetic device 162 of the solenoid 160 when the engaging portion 59 contacts the fixing member 70.

The spool bottom portion 52 is formed integrally with the spool tubular portion 51 in one-piece and closes an end portion of the spool tubular portion 51 on the solenoid 160 side. The spool bottom portion 52 can project from the sleeve 20 in the direction AU. The spool bottom portion 52 functions as a proximal end portion of the spool 50.

A space, which is surrounded by the spool tubular portion 51, the spool bottom portion 52 and the tubular portion 41 and the bottom portion 42 of the inner sleeve 40, functions as a drain oil passage 53. Therefore, the inside of the spool 50 functions as at least the portion of the drain oil passage 53. The drain oil passage 53 conducts the hydraulic oil, which is discharged from the retard chambers 141 and the advance chambers 142.

The drain inflow ports 54 are formed in the spool tubular portion 51 at a location that is between the retard-side seal portion 57 and the advance-side seal portion 58 in the axial direction of the rotational axis AX. The drain inflow ports 54 communicate between the outer peripheral surface and the inner peripheral surface of the spool tubular portion 51. The drain inflow ports 54 guide the hydraulic oil, which is discharged from the retard chambers 141 and the advance chambers 142, to the drain oil passage 53. Furthermore, the drain inflow ports 54 are communicated with each supply port SP1, SP2 through the recycle ports 47.

The drain outflow ports 55 open toward the radially outside at the spool bottom portion 52 that is the one end portion of the spool 50. The drain outflow ports 55 discharge the hydraulic oil of the drain oil passage 53 to the outside of the hydraulic oil control valve 10. As shown in FIG. 1, the hydraulic oil, which is discharged from the drain outflow ports 55, is recovered in the oil pan 352.

As shown in FIG. 3, the spring receiving portion 56 is formed at the end portion of the spool tubular portion 51 on the camshaft 320 side such that an inner diameter of the spring receiving portion 56 is increased in comparison to an inner diameter of the other portion of the spool tubular portion 51. The other end portion of the spring 60 contacts the spring receiving portion 56.

In the present embodiment, the outer sleeve 30 and the spool 50 shown in FIG. 3 are made of iron, and the inner sleeve 40 is made of aluminum. The materials of these members are not limited to these materials, and each of these members may be made of any other metal material or any resin material.

The spring 60 is a compression coil spring, and the two end portions of the spring 60 contact the bottom portion 42 of the inner sleeve 40 and the spring receiving portion 56 of the spool 50, respectively. The spring 60 urges the spool 50 in the direction AU.

The fixing member 70 is fixed to the end portion of the outer sleeve 30 on the solenoid 160 side. As shown in FIG. 4, the fixing member 70 includes a planar plate portion 71 and the fitting projections 73.

The planar plate portion 71 is shaped in a planar plate form that extends in the radial direction. The extending direction of the planar plate portion 71 is not limited to the radial direction and may be any intersecting direction that intersects the rotational axis AX. An opening 72 is formed generally at the center of the planar plate portion 71. As shown in FIG. 3, the spool bottom portion 52, which is the one end portion of the spool 50, is inserted into the opening 72.

As shown in FIG. 4, the fitting projections 73 project from the planar plate portion 71 in the direction AD and are arranged one after another in the circumferential direction. The projecting direction of the fitting projections 73 is not limited to the direction AD. For instance, the fitting projections 73 may project from the planar plate portion 71 in any intersecting direction that intersects the radial direction. Each of the fitting projections 73 is engaged with the corresponding one of the fitting portions 48 of the inner sleeve 40.

As shown in FIG. 3, the fixing member 70 is assembled such that the fitting projections 73 are engaged with the fitting portions 48 after inserting the spool 50 into the inside of the inner sleeve 40, and thereafter the fixing member 70 is fixed to the outer sleeve 30 by plastically deforming the fixing member 70 against the outer sleeve 30. An outer periphery of an end surface of the fixing member 70 on the solenoid 160 side functions as a deforming portion that is plastically deformed against the outer sleeve 30. Therefore, the outer sleeve 30 and the inner sleeve 40 are fixed. At this time, the inner sleeve 40 is assembled to the outer sleeve 30 by setting an angle around the rotational axis AX. This point will be described later.

By fixing the fixing member 70 to the outer sleeve 30 in the state where the fitting projections 73 are engaged with the fitting portions 48, the rotation of the inner sleeve 40 relative to the outer sleeve 30 in the circumferential direction is limited. Furthermore, removal of the inner sleeve 40 and the spool 50 from the outer sleeve 30 in the direction AU is limited when the fixing member 70 is fixed to the outer sleeve 30.

Each of the check valves 90 is configured to limit a backflow of the hydraulic oil. The check valves 90 include two supply check valves 91 and a recycle check valve 92. As shown in FIG. 4, the supply check valves 91 and the recycle check valve 92 are respectively formed by winding a strip-shaped thin plate in a ring form, so that the supply check valves 91 and the recycle check valve 92 are resiliently deformed in the radial direction. As shown in FIG. 3, one of the supply check valves 91 is placed at a position, which corresponds to the retard-side supply ports SP1, and the other one of the supply check valves 91 is placed at another position, which corresponds to the advance-side supply ports SP2, such that the supply check valves 91 contact the inner peripheral surface of the tubular portion 41. When the pressure of the hydraulic oil is applied to each supply check valve 91 from the radially outer side, a size of an overlapped portion of the strip-shaped thin plate of the supply check valve 91, at which two circumferential end portions of the strip-shaped thin plate are overlapped with each other, is increased, and thereby the wound strip-shaped thin plate is diametrically shrunk. The recycle check valve 92 is placed at a position, which corresponds to the recycle ports 47, such that the recycle check valve 92 contacts the outer peripheral surface of the tubular portion 41. When the pressure of the hydraulic oil is applied to the recycle check valve 92 from the radially inner side, a size of an overlapped portion of the strip-shaped thin plate of the recycle check valve 92, at which two circumferential end portions of the strip-shaped thin plate are overlapped with each other, is decreased, and thereby the wound strip-shaped thin plate is diametrically expanded.

In the present embodiment, the crankshaft 310 corresponds to a subordinate concept of a drive shaft of the present disclosure, and the camshaft 320 corresponds to a subordinate concept of a driven shaft of the present disclosure. Furthermore, the intake valves 330 correspond to a subordinate concept of valves of the present disclosure. The solenoid 160 corresponds to a subordinate concept of an actuator of the present disclosure.

(A-2. Operation of Valve Timing Adjustment Device)

As shown in FIG. 1, the hydraulic oil, which is supplied from the hydraulic oil supply source 350 to the supply hole 326, is conducted to the hydraulic oil supply passage 25 through the shaft hole 322. Like in the state shown in FIG. 3, in the state where the solenoid 160 is not energized, and thereby the spool 50 is placed in the closest position that is closest to the electromagnetic device 162 of the solenoid 160, the retard ports 27 are communicated with the retard-side supply ports SP1. Therefore, the hydraulic oil of the hydraulic oil supply passage 25 is supplied to the retard chambers 141, so that the vane rotor 130 is rotated relative to the housing 120 in the retarding direction, and thereby the relative rotational phase of the camshaft 320 relative the crankshaft 310 is changed toward the retard side. Furthermore, in this state, the advance ports 28 are not communicated with the advance-side supply ports SP2 but are communicated with the recycle ports 47. Therefore, the hydraulic oil, which is discharged from the advance chambers 142, is returned to the retard-side supply ports SP1 through the recycle ports 47 and is recirculated. Furthermore, a portion of the hydraulic oil, which is discharged from the advance chambers 142, flows into the drain oil passage 53 through the drain inflow ports 54 and is returned to the oil pan 352 through the drain outflow ports 55.

As shown in FIG. 6, in the other state where the solenoid 160 is energized, and thereby the spool 50 is placed in the furthermost position, in which the spool 50 is furthermost from the electromagnetic device 162 of the solenoid 160, i.e., the spool 50 is closest to the stopper 49, the advance ports 28 are communicated with the advance-side supply ports SP2. Therefore, the hydraulic oil of the hydraulic oil supply passage 25 is supplied to the advance chambers 142, so that the vane rotor 130 is rotated relative to the housing 120 in the advancing direction, and thereby the relative rotational phase of the camshaft 320 relative the crankshaft 310 is changed toward the advance side. Furthermore, in this state, the retard ports 27 are not communicated with the retard-side supply ports SP1 but are communicated with the recycle ports 47. Therefore, the hydraulic oil, which is discharged from the retard chambers 141, is returned to the advance-side supply ports SP2 through the recycle ports 47 and is recirculated. Furthermore, a portion of the hydraulic oil, which is discharged from the retard chambers 141, flows into the drain oil passage 53 through the drain inflow ports 54 and is returned to the oil pan 352 through the drain outflow ports 55.

Figure 7:
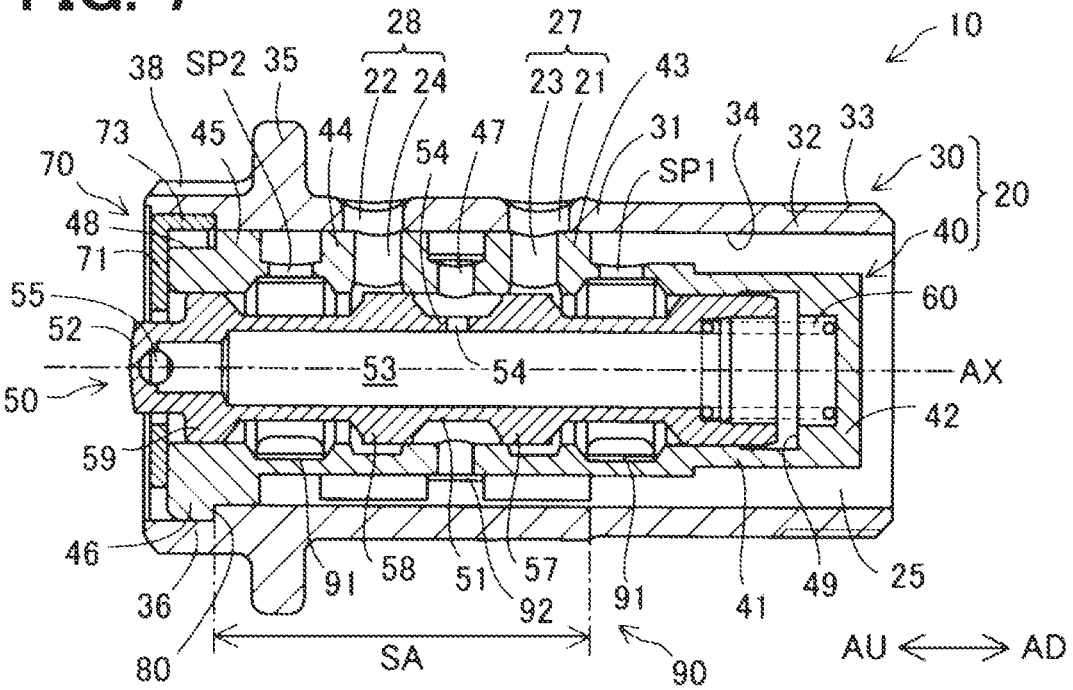
FIG. 7 is a cross-sectional view showing a state in which the spool is located substantially in the center of a sliding range.

Furthermore, as shown in FIG. 7, in a state where the spool 50 is placed generally at the center of the sliding range of the spool 50 in response to the energization of the solenoid 160, the retard ports 27 are communicated with the retard-side supply ports SP1, and the advance ports 28 are communicated with the advance-side supply ports SP2. Thus, the hydraulic oil of the hydraulic oil supply passage 25 is supplied to both the retard chambers 141 and the advance chambers 142, so that the relative rotation of the vane rotor 130 relative to the housing 120 is limited, and thereby the current relative rotational phase of the camshaft 320 relative to the crankshaft 310 is maintained.

The hydraulic oil, which is supplied to the retard chambers 141 or the advance chambers 142, flows into the receiving hole 132 through the retard chamber side pin control oil passage 133 or the advance chamber side pin control oil passage 134. Therefore, when the lock pin 150 is removed from the fitting recess 128 against the urging force of the spring 151 by the hydraulic oil supplied to the receiving hole 132 in response to the application of the sufficient hydraulic oil pressure to the retard chambers 141 or the advance chambers 142, the relative rotation of the vane rotor 130 relative to the housing 120 is enabled.

In a case where the relative rotational phase of the camshaft 320 is on the advance side of a target value, the amount of electric power supply to the solenoid 160 is made relatively small at the valve timing adjustment device 100, so that the vane rotor 130 is rotated relative to the housing 120 in the retarding direction. Therefore, the relative rotational phase of the camshaft 320 relative to the crankshaft 310 is changed toward the retard side, and thereby the valve timing is retarded. In another case where the relative rotational phase of the camshaft 320 is on the retard side of the target value, the amount of electric power supply to the solenoid 160 is made relatively large at the valve timing adjustment device 100, so that the vane rotor 130 is rotated relative to the housing 120 in the advancing direction. Therefore, the relative rotational phase of the camshaft 320 relative to the crankshaft 310 is changed toward the advance side, and thereby the valve timing is advanced. In a further case where the relative rotational phase of the camshaft 320 coincides with the target value, the amount of electric power supply to the solenoid 160 is made intermediate at the valve timing adjustment device 100, so that the relative rotation of the vane rotor 130 relative to the housing 120 is limited. Therefore, the current relative rotational phase of the camshaft 320 relative to the crankshaft 310 is maintained, and thereby the current valve timing is maintained.

The structure and the operation of the valve timing adjustment device, which are common to the embodiments, have been described. In the above description, the specific shape of the projection 35 of the outer sleeve 30 is described by using the previously proposed shape. However, the shape of the projection 35 in each of the following embodiments varies. Therefore, in each of the following embodiments, suffixes a to f are added to the reference signs of the outer sleep and the projection to clarify the difference in the shape thereof. The structure and the function of the outer sleeve 30*a*-30*f* of each of the following embodiments are the same as the structure and the function of the outer sleeve 30 described above except the structure and the function of the projection 35*a*-35*f*.

B. First Embodiment

Figure 8:
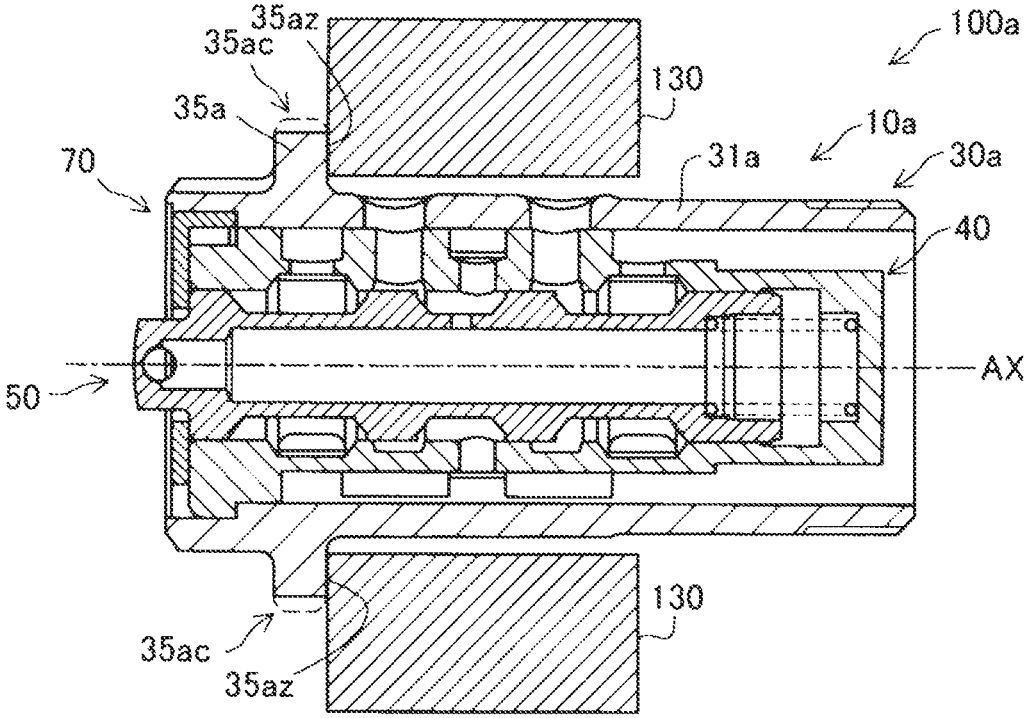
FIG. 8 is a cross-sectional view showing a detailed structure of the hydraulic oil control valve of a first embodiment.
Figure 9:
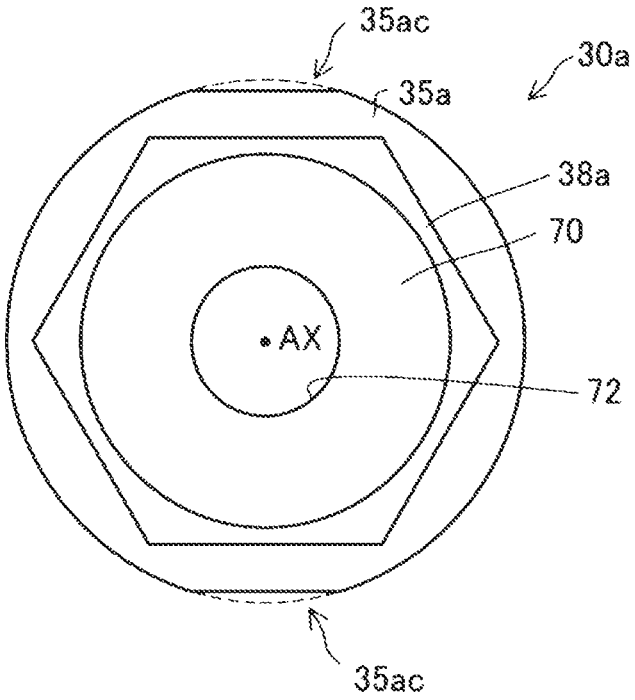
FIG. 9 is a view of an outer sleeve of the first embodiment as viewed from a solenoid side.
Figure 10:
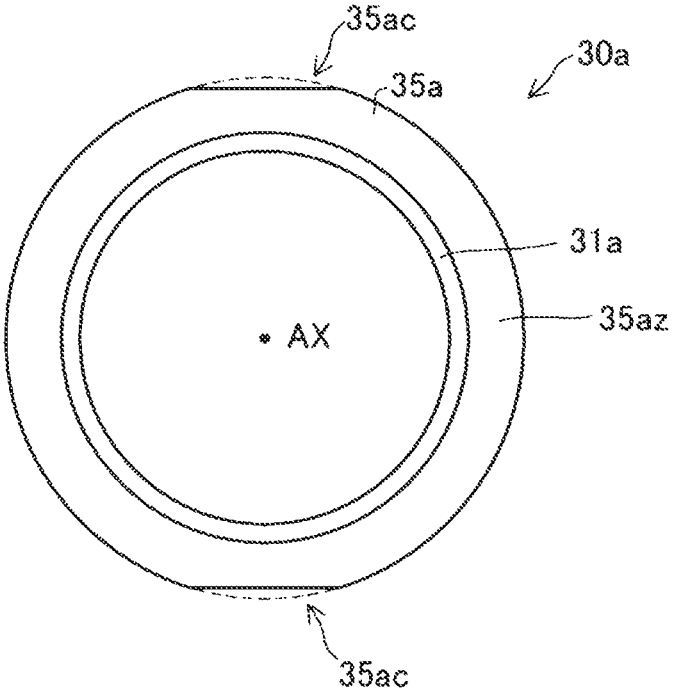
FIG. 10 is a view of the outer sleeve of the first embodiment as viewed from a camshaft side.

As shown in FIGS. 8, 9 and 10, the outer sleeve 30*a*, which is used in the valve timing adjustment device 100*a* of the first embodiment, has a plurality (more specifically, two in FIGS. 8, 9 and 10) of reference-shape portions 35*ac*, each of which is formed at an outer periphery of the projection 35*a* and functions as a reference (a positional reference) at the time of inserting the inner sleeve 40 into the outer sleeve 30*a*. In FIGS. 8 to 18, the references signs are omitted for the portions that are not relative to the characteristic features of the present disclosure. FIG. 9 is a view of the outer sleeve 30*a* as viewed from the solenoid 160 side, and FIG. 10 is a view of the outer sleeve 30*a* as viewed from the camshaft 320 side in FIG. 1. In FIG. 10, indication of the inner sleeve 40 is omitted for the sake of simplicity. As shown in FIG. 9, each of the reference-shape portions 35*ac* has a shape that is formed by cutting a corresponding part of the outer periphery of the projection 35*a* along a chord that is a straight line segment whose endpoints both lie on a circular arc of the outer periphery of the projection 35*a* shaped in the circular ring form. Therefore, each of the reference-shape portions 35*ac* is formed as a reference cutout. The reference-shape portions 35*ac* are point-symmetric or two-fold rotationally symmetric around the rotational axis AX.

Figure 11:
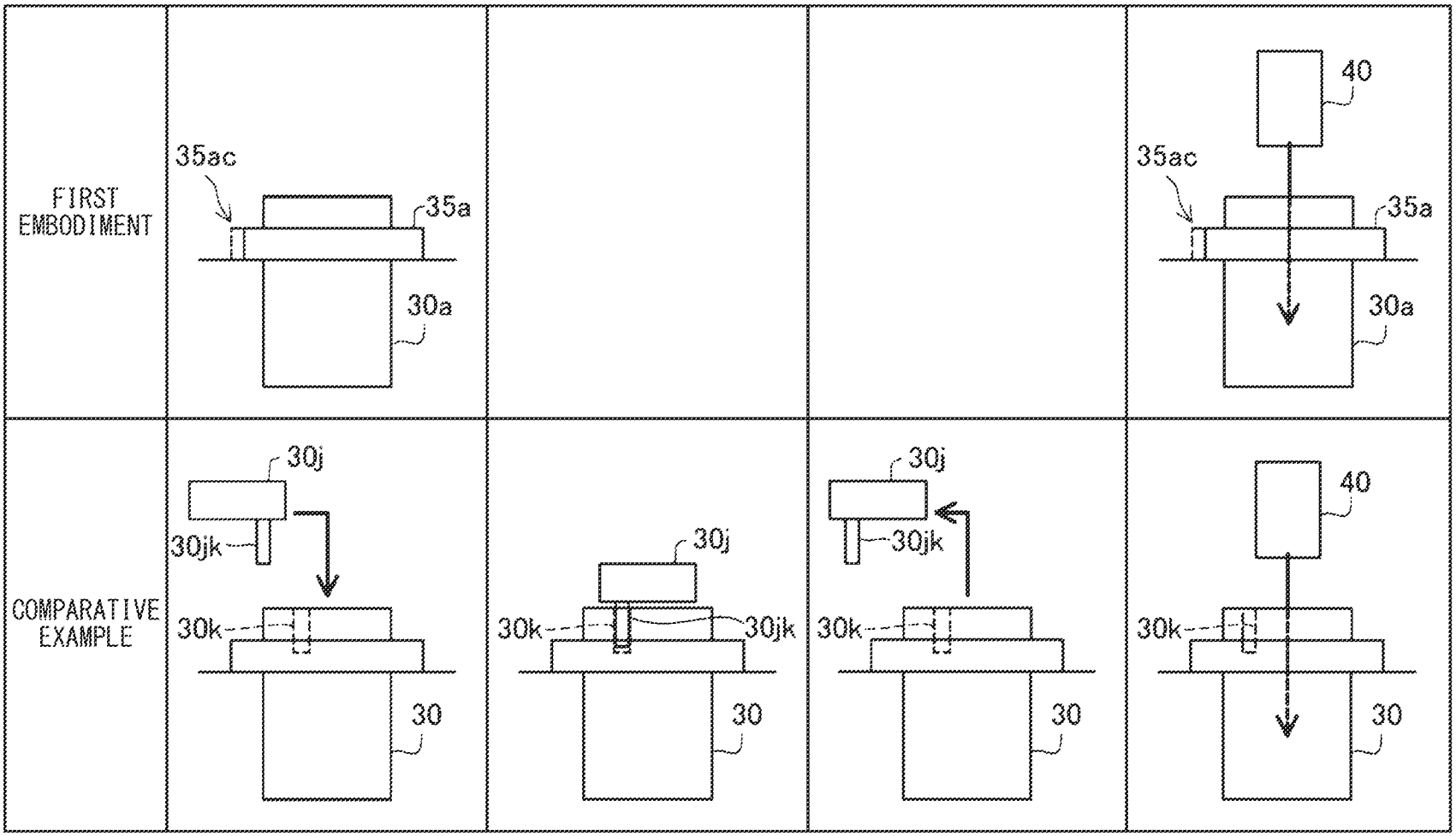
FIG. 11 is an explanatory diagram showing a process of inserting an inner sleeve into the outer sleeve.

As shown in FIG. 11, in the case of the first embodiment, the reference-shape portion 35*ac* is formed at the outer periphery of the projection 35*a* at the outer sleeve 30*a*, and the reference-shape portion 35*ac* can be visually recognized from the outside at the time of inserting the inner sleeve 40. That is, the orientation of the outer sleeve 30*a* can be recognized from the outside. In contrast, in the comparative example shown in FIG. 11, the reference-shape portion 30*k* is formed at the inside of the outer sleeve 30. Therefore, the orientation of the outer sleeve 30 cannot be recognized from the outside. In such a case, it is required to have a step of aligning an angle reference 30*jk* of an angle determining jig 30*j* and the reference-shape portion 30*k* relative to each other by using the angle determining jig 30*j*, and a step of checking the orientation of the outer sleeve 30. In other words, in the case of the first embodiment, it is not required to have the step of aligning the angle reference of the angle determining jig and the reference-shape portion relative to each other by using the angle determining jig and the step of checking the orientation of the outer sleeve 30*a*.

Figure 12:
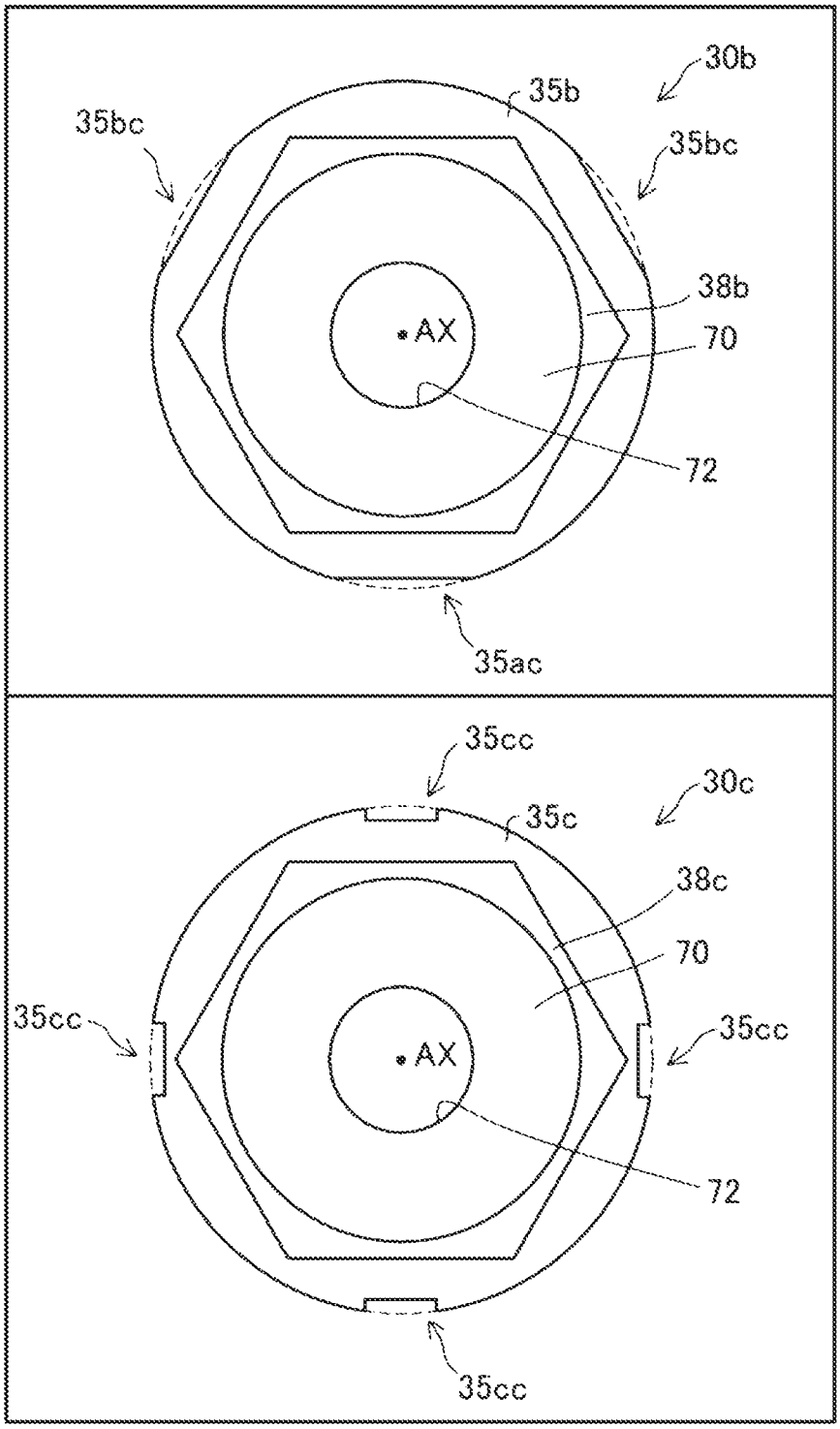
FIG. 12 is an explanatory diagram showing a modification of the first embodiment.

As shown at the upper side of FIG. 12, the reference-shape portions 35*bc* may be arranged to be three-fold rotationally symmetric around the rotational axis AX. Also, as shown at the lower side of FIG. 12, the reference-shape portions 35*bc* may be arranged to be four-fold rotationally symmetric around the rotational axis AX. Furthermore, each of the reference-shape portions 35*ac* may have the shape, which is formed by cutting the corresponding part of the outer periphery of the projection 35*a* by the chord, as shown in FIGS. 9 and 10. Alternatively, each of the reference-shape portion 35*cc* may have a shape, which is formed by cutting the corresponding part of the outer periphery of the projection 35*a* in a form of a rectangle, as shown at the lower side of FIG. 12. Each of the reference-shape portions may be cut to have another form, such as a triangle or a semicircular, which is other than the rectangle. Furthermore, each of the reference-shape portions may be formed as a through-hole on the inner side of the outer periphery of the projection. The through-hole may serve as the reference cutout.

As described above, according to the first embodiment, the reference-shape portions 35*ac*, 35*bc*, 35*cc*, each of which serves as the reference at the time of positioning the outer sleeve 30*a*, 30*b*, 30*c* relative to the inner sleeve 40, are formed at the outer periphery of the projection 35*a*, 35*b*, 35*c*. A seat surface 35*az*, 35*bz*, 35*cz* of the projection 35*a*, 35*b*, 35*c*, which fixes the vane rotor 130 between the seat surface 35*az*, 35*bz*, 35*cz* and the end portion 321 of the camshaft 320, is shaped in the rotationally symmetric form that is rotationally symmetric around the rotational axis AX. Therefore, the frictional forces, which are generated between the seat surface 35*az*, 35*bz*, 35*cz* and the vane rotor 130, are uniformly generated around the rotational axis AX. Therefore, although a resultant (a resultant force) of the frictional forces generates a couple (a pair of forces, equal in magnitude, oppositely directed), this resultant of the frictional forces does not generate a force causing a translation in a radial direction of the rotational axis AX. Thus, since a translational force is not exerted between the seat surface 35*az*, 35*bz*, 35*cz* and the vane rotor 130, the fastening between the seat surface 35*az*, 35*bz*, 35*cz* and the vane rotor 130 can be stabilized. Furthermore, the number of the steps for inserting the inner sleeve 40 into the outer sleeve 30 can be reduced.

C. Second Embodiment

Figure 13:
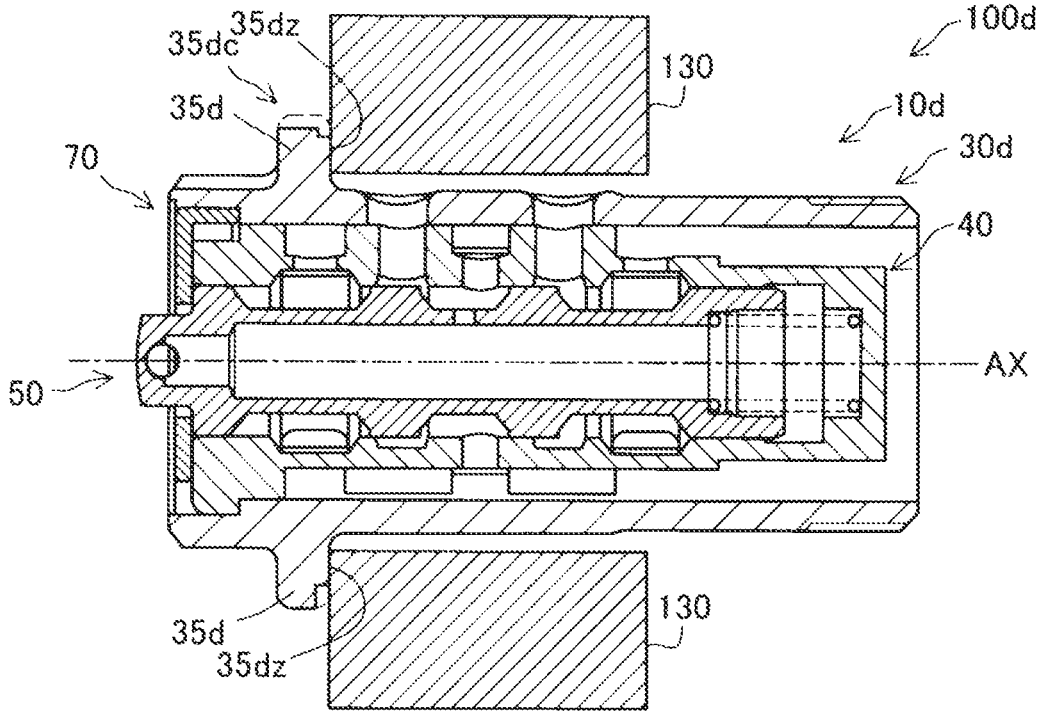
FIG. 13 is a cross-sectional view showing a detailed structure of a hydraulic oil control valve of a second embodiment.
Figure 14:
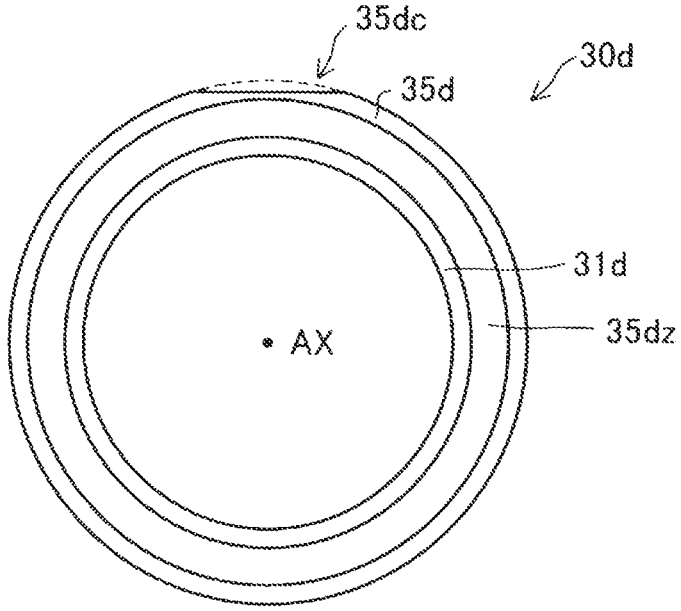
FIG. 14 is a view of an outer sleeve of the second embodiment as viewed from a camshaft side.
Figure 15:
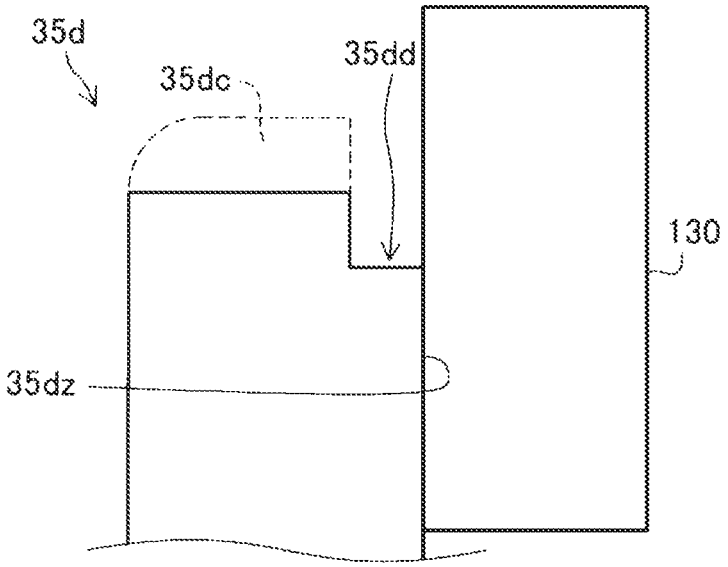
FIG. 15 is an enlarged view of a projection of the outer sleeve of the second embodiment.

As shown in FIGS. 13, 14 and 15, the outer sleeve 30*d*, which is used in the valve timing adjustment device 100*d* of the second embodiment, has a single reference-shape portion 35*dc*, which is formed at an outer periphery of the projection 35*d* and functions as a reference (a positional reference) at the time of inserting the inner sleeve 40 into the outer sleeve 30*d*. Furthermore, the seat surface 35*dz*, which contacts the vane rotor 130, is located on an inner side (a radially inner side) of a radially innermost part of the reference-shape portion 35*dc*. The seat surface 35*dz* has a stepped part (an axial recess) 35*dd* that is formed along an outer periphery of the seat surface 35*dz* all around the rotational axis AX, and a distance between the stepped part 35*dd* and the vane rotor 130 is larger than a distance between another part of the seat surface 35*dz*, which is other than the stepped part 35*dd*, and the vane rotor 130. The reference-shape portion 35*dc* does not contact the vane rotor 130. Thus, as shown in FIG. 14, the seat surface 35*dz* is shaped in a circular ring form having a uniform radial width all around the rotation axis AX. The frictional forces, which are generated between the seat surface 35*dz* and the vane rotor 130, are also uniformly generated around the rotational axis AX. Therefore, although the resultant (the resultant force) of the frictional forces generates the couple, this resultant of the frictional forces does not generate the force causing the translation in the radial direction of the rotational axis AX. Thus, the fastening between the seat surface 35*dz* and the vane rotor 130 can be stabilized.

D. Third Embodiment

Figure 16:
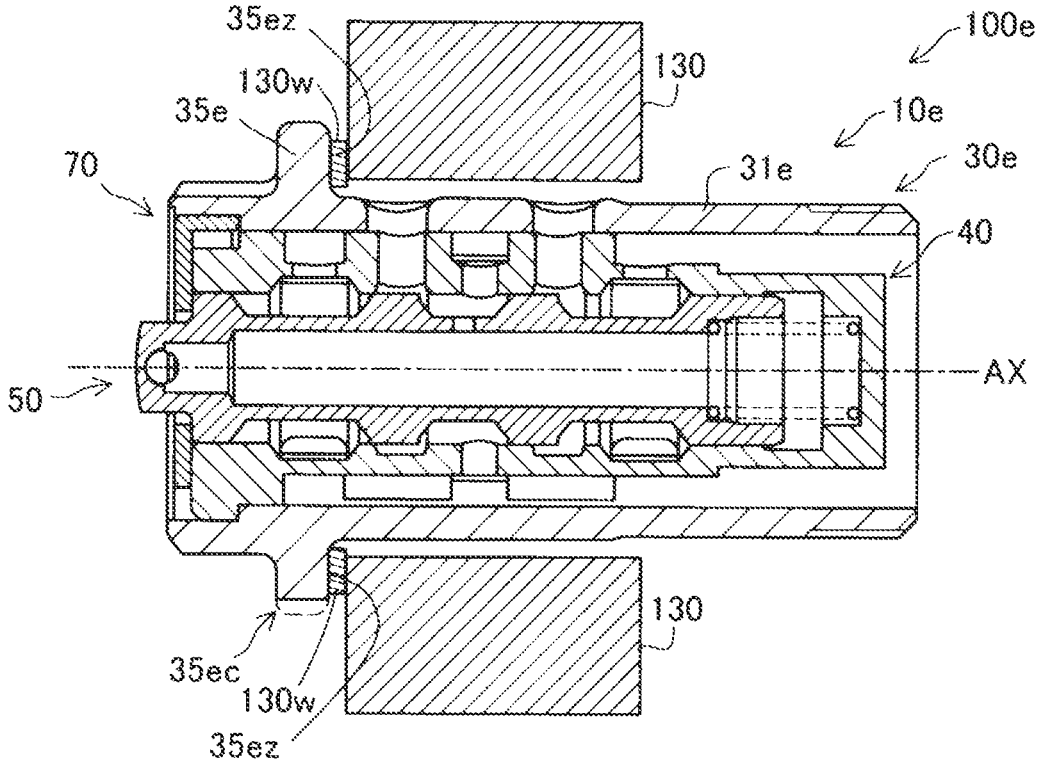
FIG. 16 is a cross-sectional view showing a detailed structure of a hydraulic oil control valve of a third embodiment.
Figure 17:
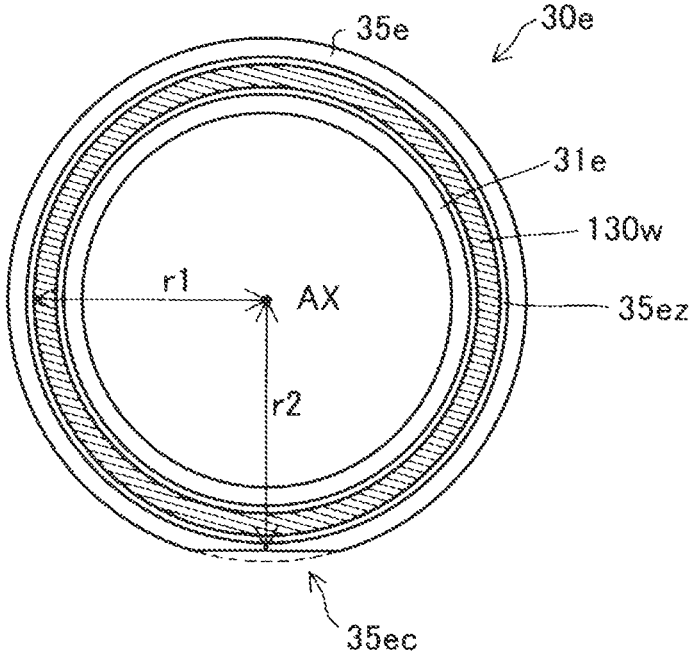
FIG. 17 is a view of an outer sleeve of the third embodiment as viewed from a camshaft side.

As shown in FIGS. 16 and 17, the outer sleeve 30*e*, which is used in the valve timing adjustment device 100*e* of the third embodiment, has a single reference-shape portion 35*ec*, which is formed at an outer periphery of the projection 35*e* and functions as a reference (a positional reference) at the time of inserting the inner sleeve 40 into the outer sleeve 30*e*. Furthermore, a washer 130*w* is placed between the seat surface 35*ez* of the projection 35*e* and the vane rotor 130. The washer 130*w* is centered on the rotational axis AX. A radius r1 of the washer 130*w* is shorter than a length r2, which is measured from the rotational axis AX to the reference-shape portion 35*ec* in the radial direction. The frictional forces between the seat surface 35*ez* and the washer 130*w* and the frictional forces between the washer 130*w* and the vane rotor 130 are generated to be rotationally symmetric around the rotational axis AX. As a result, like in the first embodiment and the second embodiment, the resultant moment of the frictional forces becomes zero, and thereby the translational force is not exerted between the seat surface 35*ez* and the washer 130*w* and also between the washer 130*w* and the vane rotor 130. Thus, the fastening between the seat surface 35*ez* and the vane rotor 130 through the washer 130*w* can be stabilized.

E. Fourth Embodiment

Figure 18:
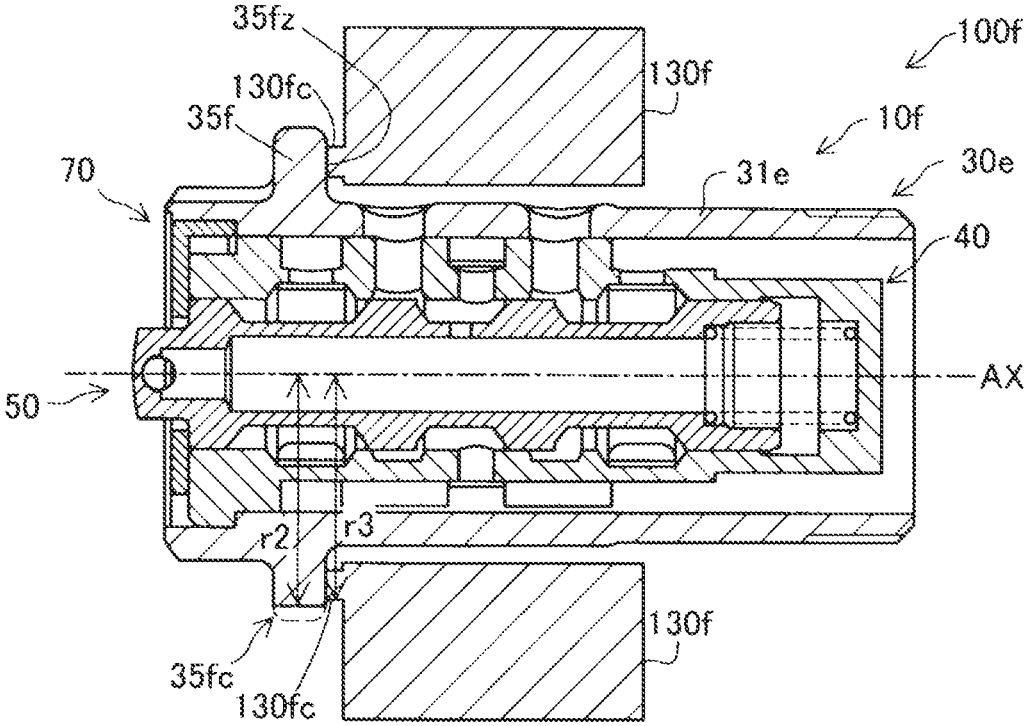
FIG. 18 is a cross-sectional view showing a detailed structure of a hydraulic oil control valve of a fourth embodiment.

As shown in FIG. 18, the outer sleeve 30*f*, which is used in the valve timing adjustment device 100*f* of the fourth embodiment, has a single reference-shape portion 35*fc*, which is formed at an outer periphery of the projection 35*f* and functions as a reference (a positional reference) at the time of inserting the inner sleeve 40 into the outer sleeve 30*f*. The vane rotor 130*f* has a rotor projection 130*fc* which is located on the side of the vane rotor 130*f* where the projection 35*e* of the outer sleeve 30*f* is placed, and the rotor projection 130*fc* contacts the seat surface 35*fz*. The rotor projection 130*fc* is shaped in a circular ring form that is centered on the rotational axis AX. That is, the rotor projection 130*fc* is shaped in a rotationally symmetric form that is rotationally symmetric around the rotational axis AX. A length r3, which is measured from the rotational axis AX to an outer peripheral surface of the rotor projection 130*fc* in the radial direction, is shorter than the length r2, which is measured from the rotational axis AX to the reference-shape portion 35*fc* in the radial direction. Therefore, the frictional forces between the seat surface 35*fz* and the rotor projection 130*fc* of the vane rotor 130*f* are generated to be rotationally symmetric around the rotational axis AX. As a result, like in the first embodiment, the second embodiment and the third embodiment, the resultant moment of the frictional forces becomes zero, and thereby the translational force is not exerted between the seat surface 35*fz* and the vane rotor 130*f*. Thus, the fastening between the seat surface 35*fz* and the vane rotor 130*f* can be stabilized.

In the third embodiment and the fourth embodiment, the projection 35*e*, 35*f* has the single reference-shape portion 35*ec*, 35*fc*. Alternatively, the projection 35*e*, 35*f* may have a plurality of reference-shape portions 35*ec*, 35*fc*. Furthermore, in the case where the projection 35*e*, 35*f* has the plurality of reference-shape portions 35*ec*, 35*fc*, as long as the seat surface 35*ez* and the seat surface 35*fz* are shaped in the rotationally symmetric form, the reference-shape portions 35*ec*, 35*fc* may be arranged to be rotationally symmetric or may not be arranged to be rotationally symmetric.

In each of the above-described embodiments, the one or more reference-shape portions 35*ac*-35*fc* are formed at the outer periphery of the projection 35*a*-35*f*. Alternatively, the one or more reference-shape portions 35*ac*-35*fc* may be formed at an opposite surface of the projection 35*a*-35*f* which is opposite to the vane rotor 130, 130*f* in the axial direction of the rotational axis AX. Since the seat surface 35*az*-35*fz* is shaped in the rotationally symmetric form, the frictional forces between the seat surface 35*az*-35*fz* and the vane rotor 130, 130*f* are generated to be rotationally symmetric around the rotational axis AX. As a result, the resultant moment of the frictional forces becomes zero, and thereby the translational force is not exerted between the seat surface 35*az*-35*fz* and the vane rotor 130, 130*f*. Thus, the fastening between the seat surface 35*az*-35*fz* and the vane rotor 130, 130*f* can be stabilized.

The present disclosure is not limited to the above-described embodiments and modifications, and can be realized in various configurations within a range not deviating from the gist thereof. For example, the technical features of the embodiments and modifications corresponding to the technical features in the summary of the invention can be appropriately replaced or combined to solve a part or all of the above-mentioned disadvantages or to achieve a part of all of the above-mentioned advantages. Furthermore, if the technical feature(s) is not described as essential in the present specification, it can be appropriately deleted.

What is claimed is:

1. A valve timing adjustment device configured to adjust an opening timing and a closing timing of a valve, which is installed at an internal combustion engine, relative to a rotational phase of a drive shaft of the internal combustion engine, the valve timing adjustment device comprising:

a hydraulic oil control valve that includes:

an outer sleeve that is shaped in a tubular form and has a projection at an outer periphery of the outer sleeve;

an inner sleeve that is located on an inner side of the outer sleeve; and a spool that is located at an inside of the inner sleeve and is configured to reciprocate forward and backward along a rotational axis of the outer sleeve, wherein the inner sleeve and the outer sleeve are assembled together to form a plurality of ports, each of which serves as an oil passage, and a hydraulic oil pressure of hydraulic oil, which is supplied from a hydraulic oil supply source through corresponding one or more of the plurality of ports, is controlled by reciprocating the spool forward or backward;

an actuator that is configured to control reciprocation of the spool; and a vane rotor that is installed between a driven shaft and the drive shaft while the driven shaft is configured to open and close the valve in response to rotation of the drive shaft, wherein the vane rotor is configured to change a rotational phase of the driven shaft relative to the drive shaft according to the hydraulic oil pressure of the hydraulic oil supplied from the hydraulic oil control valve, wherein:

a reference-shape portion, which serves as a reference at a time of positioning the outer sleeve relative to the inner sleeve, is formed at an outer periphery of the projection; and a seat surface of the projection, which fixes the vane rotor between the seat surface of the projection and an end portion of one of the drive shaft and the driven shaft, is shaped in a rotationally symmetric form that is rotationally symmetric around the rotational axis.

2. The valve timing adjustment device according to claim 1, wherein the seat surface is located on an inner side of a radially innermost part of the reference-shape portion.

3. The valve timing adjustment device according to claim 2, wherein the seat surface has a stepped part that is formed along an outer periphery of the seat surface, and a distance between the stepped part and the vane rotor is larger than a distance between another part of the seat surface, which is other than the stepped part, and the vane rotor.

4. The valve timing adjustment device according to claim 2, comprising a washer placed between the seat surface and the vane rotor.

5. The valve timing adjustment device according to claim 2, wherein the vane rotor has a rotor projection that projects toward the seat surface.

* * * * *